United States Patent [19]

Corbellini

[11] 4,106,981

[45] Aug. 15, 1978

[54] PROCEDURE FOR OBTAINING ELEMENTS TO SUPPORT THE WIRE IN CONTINUOUS FORMING TABLES OF PAPER-MAKING MACHINES, AND THE ELEMENTS DERIVED THEREBY FOR SUPPORTING THE WIRE

[76] Inventor: Glauco Corbellini, via Carducci, 33100 Udine, Italy

[21] Appl. No.: 607,694

[22] Filed: Aug. 25, 1975

Related U.S. Application Data

[63] Continuation of Ser. No. 426,657, Dec. 20, 1973, abandoned.

[30] Foreign Application Priority Data

Dec. 20, 1972 [IT] Italy ..... 83450 A/72
Dec. 20, 1972 [IT] Italy ..... 83451 A/72

[51] Int. Cl.[2] ..... D21F 1/54
[52] U.S. Cl. ..... 162/352; 162/374; 15/236 A
[58] Field of Search ..... 162/352, 374; 15/236 A; 30/169

[56] References Cited

U.S. PATENT DOCUMENTS

| | | | |
|---|---|---|---|
| 3,393,124 | 7/1968 | Klingler et al. | 162/352 |
| 3,432,385 | 3/1969 | Thorp | 162/352 |
| 3,446,702 | 5/1969 | Buchanan | 162/352 |
| 3,496,064 | 2/1970 | Scott | 162/374 |
| 3,793,140 | 2/1974 | Corbellini | 162/352 |
| 3,884,757 | 5/1975 | Beacom et al. | 162/374 |

*Primary Examiner*—Richard V. Fisher
*Assistant Examiner*—George C. Yeung
*Attorney, Agent, or Firm*—A. W. Breiner

[57] ABSTRACT

This disclosure relates to a support for the moving wire of a continuous forming table of paper-making machines, the support being in the form of a water removing blade over which the wire runs with the blade having a hardened nose opposing the direction of wire movement and a rear portion over which the wire may readily slide. The blade may also have openings therethrough and a supporting beam therefor may have a section applied thereto so as to facilitate water removal. The disclosure relates also to the manner in which such blades are formed.

4 Claims, 5 Drawing Figures fig. 2
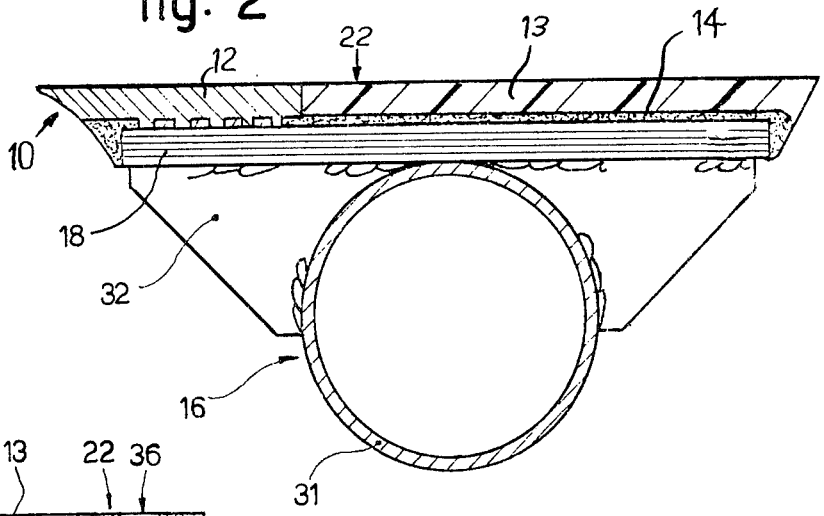
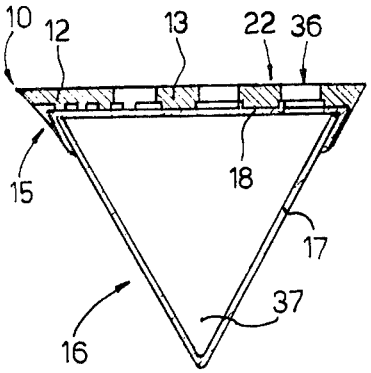
fig.5
fig. 1
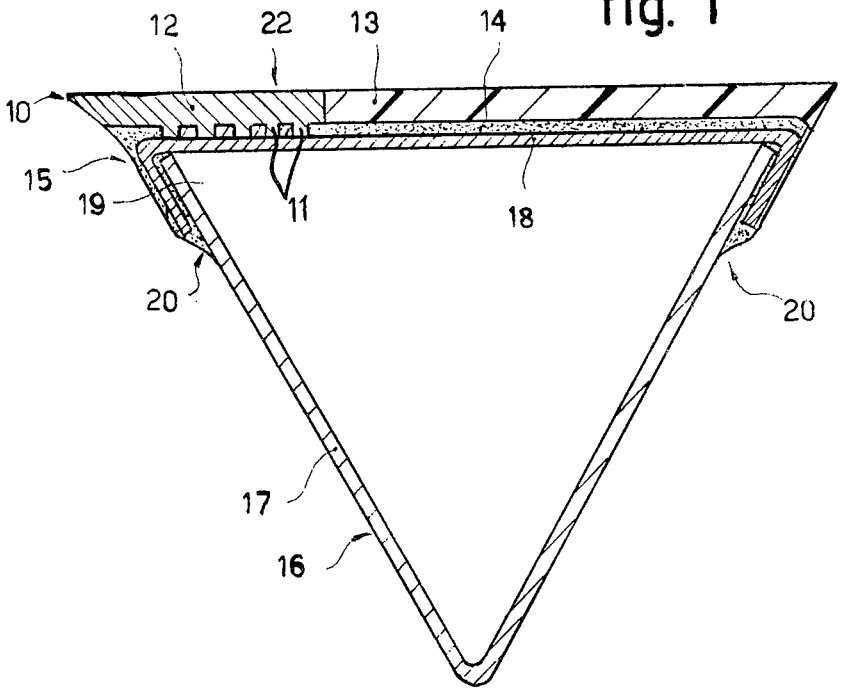

PROCEDURE FOR OBTAINING ELEMENTS TO SUPPORT THE WIRE IN CONTINUOUS FORMING TABLES OF PAPER-MAKING MACHINES, AND THE ELEMENTS DERIVED THEREBY FOR SUPPORTING THE WIRE

This is a continuation of application Ser. No. 426,657 filed Dec. 20, 1973, now abandoned.

The present invention relates to a new procedure for obtaining elements to support the wire in continuous forming tables of paper-making machines and, by derivation, to the supporting elements thereby obtained for continuous tables of paper-making machines. The continuous tables are those parts of paper-making machines on which the pulp is made to pass so that the water contained therein shall be extracted whilst it is passing over a bed made of a belt of metallic or plastic net, onto which it is deposited; the extraction is carried out and accentuated precisely by the supporting elements, which can be the object of the present procedure, and by blades, suction boxes, deflectors etc. obtained by and/or obtainable by said procedure.

So as to simplify the description, we shall hereafter only deal with the specific case of the blades although it must be clearly understood that the whole can be extended to cover suction boxes, deflectors, forming boards etc.

BACKGROUND OF THE INVENTION

Various types of blades are known. In current practice the known types are generally characterized by a continuous surface of a certain width, which support the wire transversely and across its direction of forward movement. Said surface must be maintained in a space in a pre-set position and with a very careful geometrical precision; this is obtained by providing a suitable beam, which serves to support said continous surface.

So as to make possible a practical use of the blades, in current known techniques a composite blade is utlized in which there are a carrier part and a sliding part, the two parts being joined or held together by means of screws, dovetailing or other mechanical means.

With the technology used so far, blades formed of one single block have been neither practical in use nor convenient.

Known types of blades essentially have the following defects; they are expensive and heavy; they require multiple and complex processing and they are not easy to handle.

SUMMARY OF THE INVENTION

So as to avoid all this, a new procedure to obtain said blades has been planned and, as a result, blades have been obtained by the adoption of the procedure.

One purpose of the present invention, therefore, has been to make it possible to obtain blades, suction boxes, deflectors etc. by avoiding multiple processing operations after assembly.

A further purpose is to obtain blades, suction boxes etc. of a more economical cost and, therefore, less burdensome.

Yet another purpose is to be able to obtain blades, suction boxes etc. which, while the geometry and dimensions (where necessary) of the upper part of said elements are kept constant, can be produced with a constant or variable section so as to keep deflection within the values required for any width of the table.

A further purpose is to obtain blades, suction boxes etc. which can be easily handled.

Yet another purpose is to equip the various parts of a blade, suction box etc. with materials most suited to the requirements of the table.

It is also a purpose to be able to produce by the above-mentioned procedure blades, suction boxes etc. which at the same time have the same attachments as the blades, suction boxes etc. already known, so as to make them more easy to apply.

It is, therefore, an advantage to be able to obtain blades, suction boxes, deflectors etc, which, when their components have once been assembled and mutually fixed together, need not thereafter undergo mechanical processing before being set to work.

It is an advantage for paper manufacturers to be able to use such elements at a cost 60–70% lower than that of the known blade-plus-beam complexes.

It is also an advantage to be able to adapt the section resistant to bending, in relation to the maximum allowable deflection, without having to modify the geometry of the upper part of the elements.

It is a derived advantage to be able to make such elements for paper-making machines easy to handle.

It is an important advantage to be able to adopt the most suitable materials for various parts of the blades, suction boxes, deflectors etc.

By derivation it is an advantage for owners of paper-making machinery that blades, suction boxes etc. made in accordance with our procedure can adopt the same attachments as elements already known. Therefore, in accordance with the procedure, blades, suction boxes etc. can be obtained with a carrying, water-removing edge made either of ceramic elements or of metallic elements with a hardened and/or inserted surface or of metallic elements made of hard metal or of continuous or discontinuous metallic elements made of a hard alloy —with a cobalt base, for example.

The procedure is essentially based on the use of resins of one or more components, which, depending on the type and/or the end-use, serve to produce the required anchorage of and bond between the parts or, indeed, the required plane for sliding and evacuation.

In accordance with the first form of the procedure there are placed on a suitable locator surface in the required timed position the continuous or discontinuous elements composed of hard material; next comes the setting with the first resin of a hard matrix, which serves to produce the sliding surface; upon this is placed the beam, composed of one or more elements, which is then set in position by means of the use of resins on the base which has been prepared therefor.

In accordance with a second form of the procedure, the hard elements (or a continuous bar of hard material) are placed on the locator surface in the timed position required after having been processed and made ready for use; then the part which is in contact or almost in contact with the locator surface is ready and complete in all particulars as soon as it has been extracted.

Again, by means of our procedure it is possible to use either composite pre-welded beams for the longitudinal stiffening of the elements of the table or else elements to be assembled and fixed to each other by the use of resins during construction of the beam.

We have, therefore, the position that the procedure for obtaining elements to support the wire in continuous forming tables of paper-making machines, wherein said elements constitute water-removing blades, suction boxes etc. and wherein the parts subject to wear are made of a hard material such as a ceramic or sintered material, hard metal alloys, metal alloys based on cobalt etc. is characterized by having in reciprocal succession and relative coordination:

The reciprocal and timed positioning of the parts made of a hard material on and in respect of a negative mould of at least one part of the support element to be obtained.

Sizing with a filling resin.

Fixture of the supporting beam by means of a resin, the parts made of a hard metal being already fully processed and the supporting element thus obtained being completed and ready for use.

The water-removing blades obtained by our procedure for use with continuous tables of paper-making machines, since their leading edge is made of a hard material (ceramic, sintered, hard metallic alloys, cobalt-based metallic alloys) and the remaining upper rear part is made of a hard wear-resistant resin, are characterized by having in mutual coordination and cooperation:

A leading edge made of a hard material

An upper rear sliding surface of hard resin

A supporting beam united by a resin to said leading edge and to said upper surface, the blade being taken out completed from the assembly mould.

Thus the suction boxes, obtained by means of the procedure of the invention, for continuous tables of paper-making machines have an upper surface, on which the wire of the forming table runs, made of hard continuous material or of hard composite material, the hard material consisting of ceramic or sintered material or of hard metal alloys or of cobalt-based metal alloys, and are characterized by the fact that they have in mutual coordination and cooperation:

An upper surface of hard material

A lower suction chamber fixed with resin to said upper surface, the suction box being removed already complete from the assembly mould.

The elements for forming tables of paper-making machines, can, therefore, appear in several different forms; the first difference appears in the material used and the form of the material adopted for the leading edge which removes water; a second difference is provided by the form of the beam, and a further difference comes from the method used to produce the beam.

Thus we can have blades with a supporting beam shaped like a T or a double T or with a triangular, round, rectangular or square shape or with another shape to suit the requirements or economics of each particular case.

We could also have the supporting wire or leading edge of blades or the upper surface of suction boxes made from ceramic elements or from elements of a hard metal or of sintered metal or else of steel perhaps toughened over half its surface or else of a hard metal alloy — cobalt-based, for example.

Furthermore, the leading edge or the upper surface of the suction box could be produced as one continuous whole or in the form of elements joined together and positioned in a timed manner and fixed with a resin so as to form a continuous line.

With reference to the above, we have shown in the attached tables some possible preferred layouts, which we have supplied as non-limitative examples, so as to set out the invention better and, at the same time, to show new and better uses.

Referring to the figures, we have the following:

FIG. 1 shows a water-removal blade with its edge or point made of a cobalt-based metal alloy and with a triangular beam made of two pieces.

FIG. 2 shows a blade of the type of FIG. 1 but with a toric tubular carrying beam.

FIG. 5 shows a water-removing blade with the additional functions of a suction box.

In the figures the same parts or parts performing the same functions are given the same numbers.

Figure 3:
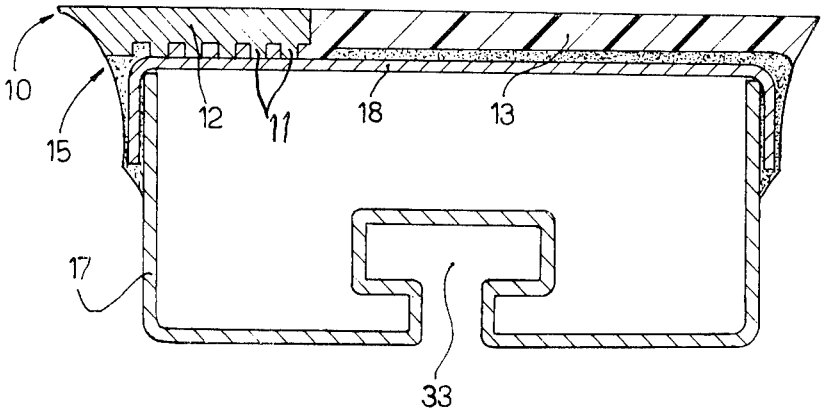
FIG. 3 shows a blade of the type of FIG. 1 but with a carrying beam suitable for installation bayonet-wise on existing supports.

Referring to the figures, we have the following: 10 is the point or leading edge, which delimits the drip pan 15 and the upper surface of the blade 22; 12 is the element made of hard material with which the edge 10 has been produced; the hard material is, for example, of a cobalt-based type; 12 may have (but not necessarily) rough downward protrusions 11, which latter could have the function of anchoring the element 12 better; 13 is the resin which serves to complete the upper surface 22 downstream from the element 12; 14 is the layer of resin-adhesive which serves to fix the carrying beam 16 onto the parts of which the upper surface 22 is composed; 16 is, as we have said, the matrix beam and preferred section; 17 and 18 are the parts of which, in our example, the carrying beam is composed. An important factor in the application of the procedure is that the various component parts, whether they be the element 12 or the resin 14 or the beam 16, must have the same or almost the same coefficient of linear expansion; in any case, the reciprocal interaction of the coefficient of expansion and of the elasticity modulus must not bring about appreciable stress. With the resin-adhesive from which the part 14 has been made we also proceed to complete the drip pan 15, and by glueing the elements 17 and 18 together at 20 reciprocal fixture together of the two parts constituting the carrying beam 16 is obtained.

The procedure (see FIG. 4) is carried out essentially as follows; the locating surface-mould 21 is made ready and this has the surface 29, the locating part 26 (which can perhaps be removed by operating the screw 28) and a movable-adjustable locating part 26; next we begin to position the elements 12 (or else the bar 12, depending on circumstances), placing them adjacent surface 29 and against the locating part 26; the elements 12 can be held in the exact position required either by possible mechanic means 23 or by magnetic elements 25 (in cases when the basic material of which the element 12 consists is sensitive to magnetic attraction).

The bars 12 (or elements 12) have had all necessary processing completed when they are inserted into the locating surface-mould. Then the elements 12 have been positioned, the resin 13 is poured in, perhaps incorporating some reinforcing means, such as metallic or fibrous elements (not illustrated here).

The resin 13 fixes itself on one side onto the part 30 of the element 12 and on the other side it follows faithfully the shape of the surface 29 and the possible locator shaping 26.

If the element 12 has been clamped from above by bridges or otherwise (for instance, the bridge 23, removal of such means is next carried out.

When the resin has thus been poured and the upper part of the blade has been produced (upside down), application of the part 18 of the carrying beam 16 is next carried out. Said part 18 is positioned adjacent a bed of adhesive resin 14, which has been spread extending on the element 12 and on resin layer 13. The resin adhesive constituting the layer 14 can be the same as the resin 13, and mutual anchorage is increased by the presence of cuttings or suitable holes.

This part of the water-removing blade can be the same irrespective of the length of the blade itself or of the type of support of the blade itself.

Figure 4:
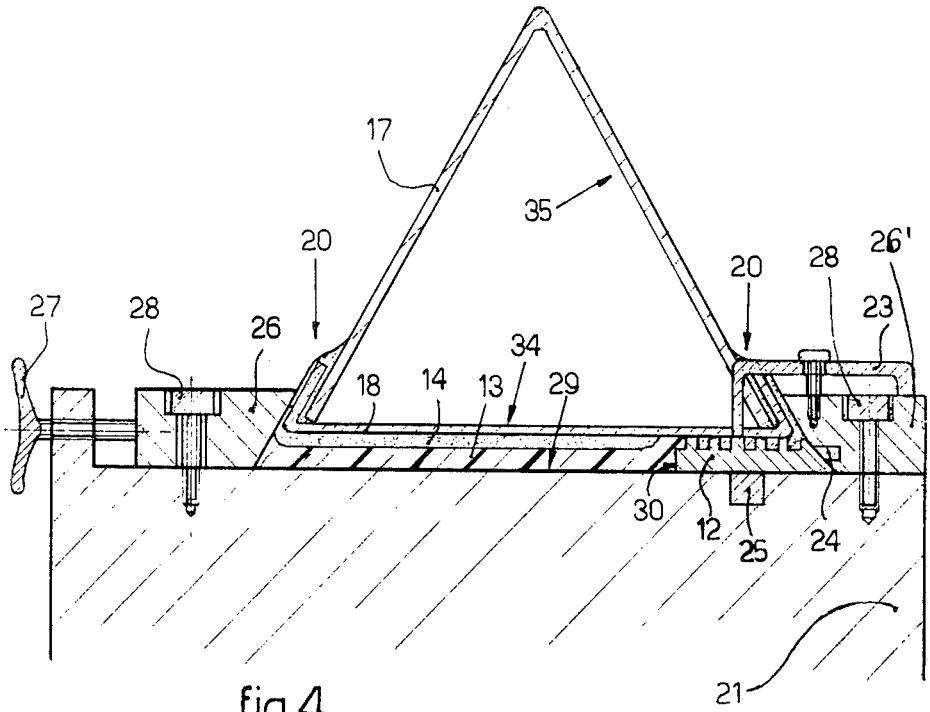
FIG. 4 shows a possible locator-plane mould for carrying out the procedure.

In the case illustrated in FIGS. 1, 4 and 5, the beam has a triangular shape, whilst in FIG. 2 the beam is composed of a combination of elements supported by the tube 31 and stiffened by the panels 32.

In FIG. 3 on the other hand, the beam has a T-shaped hollow 33, which serves for insertion of the blade into suitable carrying and positioning supports.

Next the element 17 is applied by pouring resin at 20 so as to obtain the required bond between the parts 17 and 18. The resin 14 also serves to produce the drip pan 15. When the various elements have been mutually fixed together and the resins are dry, it is sufficient to loosen the clamping means 28, to pull back 26 and, perhaps, to remove 26, and the blade is then ready for use.

If required, the procedure can be varied in one or more ways without departing from the essence of the invention.

Thus, for example, in a hypothetical case we could pre-meld or pre-glue the elements 17 and 18 together, or it would be possible to augment fixture together with pressure rivets or pull rivets which could be applied as soon as the resin has been poured.

By applying the element 17 to 12 and 13 after 18 has been glued down, it is possible to obtain semi-finished pieces which can then be completed by applying elements 17 made in sizes suitable for the length of the blade. Once the various pieces have been mutually positioned and resined together, the part protruding from the surface/locator-mould is coated with a protective resin. This operation can have been already carried out, for example, on the inner faces of the elements 17 and 18 also, namely 35 and 34, before mutual assembly.

By means of the procedure indicated it is possible to produce pre-curved surfaces/locator-moulds 21 or pre-curvable surfaces/locator moulds so as to impart a catenary curve to the blade in relation to its section, its length and its restraints in such a way that during operation it shows a zero or almost zero deflection. Thus either the element 12 or the resin 13 or the element 18 and possibly 17 could be reciprocally located on a surface/locator-mould which reproduces the catenary curve which the system will take up when put into application.

Said surface/locator-mould 21 can be adjusted in its reproduction of the catenary angle so as to be able to adjust the latter to the various configurations which it may assume in relation to the parameters encountered.

Due to the possibilities offered by the invention and in view of the fact that the core of the beam is hollow, it is possible to obtain suction boxes, deflectors, forming boards etc. or indeed it is possible to produce a combination of one or more of said elements for supporting the wire; for example, it is possible to produce a blade with the functions of a suction box, as exemplified in FIG. 5. In such a case, the part 13 of the upper surface, which has some slits 36 through which the vacuum present on the inside 37 of the hollow beam 16 (in a preferred shape) is transmitted to the lower surface of the forming table, can either be made of the same material as the element 12 or be made of a combination of resins and wear-resistant elements similar to or the same as 12. Therefore, the part 13 could form one single body together with 12 or else could be composed of strips of a hard material, running longitudinally and parallel to each other. In such cases the mould 21 will provide suitable devices for positioning the single longtitudinal strips or the elements uniting to constitute the part 13. By means of the procedure outlined, the section of the suction boxes can be obtained in progressively varying ways towards the suction outlet or outlets.

We have described here a procedure for some types of elements for supporting forming tables, but variants and combinations can be introduced without departing from the field of the invention. Thus it is possible to fix to the shaping 21 the element 12 (or the elements 12) with a suction action; it is also possible to provide the element 18 with lateral adjuncts bearing means for fixing the remaining part of the beam, for example, by means of screws or other means; it is also possible to arrange for the beam to have a section shaped like a T or double T or square or rectangular or in any other geometric shape; it is also possible for the lower part of the blade or suction box to have means for anchorage to or mutual positioning against pre-existing supports; thus the mould can have its two location surfaces fixed solid or adjustable or movable; again, either the blades or the suction boxes could have supports only at their extremities; and we could have water-removing blades acting as suction boxes as well etc. These and other variations can be produced without departing from the essence of the discovery.

I claim:

1. In combination a paper-making machine and a water removing blade element, said blade element comprising a pre-formed blade having a leading edge made of a hard ceramic or metallic material; a resin support means united by a resin to said blade, and a support beam bonded to said blade and support means with an adhesive resin.

2. The combination of claim 1 wherein the coefficient of linear expansion of said blade and said resin support means are substantially the same.

3. The combination of claim 2 wherein the resin of said support means and said adhesive resin bonding said support beam are at least in part made up of the same resin.

4. A blade element comprising a pre-formed blade having a leading edge made of a hard material; a resin support means integrally moulded to said blade, and a support beam bonded to said blade and support means with an adhesive resin.

* * * * *